US006832496B2

(12) United States Patent
Tholander et al.

(10) Patent No.: US 6,832,496 B2
(45) Date of Patent: Dec. 21, 2004

(54) METHOD FOR MONITORING/ADJUSTING PRODUCTION IN A KNITTING MACHINE, AND A MONITORING/ADJUSTING DEVICE THEREFOR

(75) Inventors: Lars Helge Gottfrid Tholander, Haverdal (SE); Kurt Arne Gunnar Jacobsson, Ulricehamn (SE); Friedrich Weber, Herzogsweiler (DE); Ludwig Ketterer, Schramberg (DE)

(73) Assignees: Memminger-IRO GmbH, Dornstetten (DE); IRO AB, Ulricehamn (SE)

( * ) Notice: Subject to any disclaimer, the term of this patent is extended or adjusted under 35 U.S.C. 154(b) by 0 days.

(21) Appl. No.: 10/472,310

(22) PCT Filed: Mar. 13, 2002

(86) PCT No.: PCT/EP02/02787

§ 371 (c)(1),
(2), (4) Date: Feb. 17, 2004

(87) PCT Pub. No.: WO02/081801

PCT Pub. Date: Oct. 17, 2002

(65) Prior Publication Data

US 2004/0154339 A1 Aug. 12, 2004

(30) Foreign Application Priority Data

Mar. 16, 2001 (DE) ..... 101 12 795

(51) Int. Cl.[7] ..... D04B 35/00
(52) U.S. Cl. ..... 66/125 R
(58) Field of Search ..... 66/125 R, 131, 66/132 T, 132 R, 231, 232, 157, 238, 7, 8, 13

(56) References Cited

U.S. PATENT DOCUMENTS 4,194,375 A * 3/1980 Marchisio ..... 66/132 T
4,764,875 A * 8/1988 Carrotte et al. ..... 66/125 R
5,511,392 A * 4/1996 Sawazaki et al. ..... 66/54
6,124,803 A 9/2000 Hamma
6,151,925 A * 11/2000 Earl et al. ..... 66/132 T
6,450,347 B1 9/2002 Hannecke

FOREIGN PATENT DOCUMENTS

| | | |
|---|---|---|
| DE | 82 24 194.5 U1 | 2/1983 |
| EP | 0 385 988 B1 | 9/1990 |
| EP | 0 420 836 B1 | 4/1991 |
| EP | 0 452 800 A1 | 10/1991 |

(List continued on next page.)

OTHER PUBLICATIONS

International Search Report dated Aug. 30, 2002 in PCT International Application No. PCT/EP02/02787 (2 pages).

*Primary Examiner*—Danny Worrell
(74) *Attorney, Agent, or Firm*—Flynn, Thiel, Boutell & Tanis, P.C.

(57) ABSTRACT

In order to monitor/adjust production in a circular knitting machine including several knitting systems and several yarn feeder devices, yarn is fed to active knitting systems from several supply devices operating according to at least two different yarn feeding principles, and in a non-positive manner. The individually fed amounts of yarn are continuously measured by means of scanned real rotation signals of the feeder devices. In order to obtain monitoring information and/or adjustment measures, comparisons are made with corresponding set amounts of yarn within at least one range of tolerance, the extent of which is adapted at least to yarn quality and/or yarn path parameters. At least one user interface can be configured in a display in a computerised production monitoring/adjustment device, whereby it is possible to select therein each individual yarn feeder device according to an optimum yarn transport principle for a specific knitting system, from a plurality of yarn feeder devices which are arranged on the knitting machine in an operative state.

22 Claims, 4 Drawing Sheets

FOREIGN PATENT DOCUMENTS

| | | |
|---|---|---|
| EP | 0 489 307 A1 | 6/1992 |
| EP | 0 600 268 A1 | 6/1994 |
| EP | 0 752 631 A1 | 1/1997 |
| EP | 0 959 742 B1 | 1/1999 |
| EP | 1 176 244 A2 | 1/2002 |
| EP | 1 176 244 A3 | 1/2002 |
| FR | 2 669 045 | 5/1992 |

* cited by examiner

METHOD FOR MONITORING/ADJUSTING PRODUCTION IN A KNITTING MACHINE, AND A MONITORING/ADJUSTING DEVICE THEREFOR

FIELD OF THE INVENTION

The invention relates to a method for monitoring/adjusting production in a knitting machine, and a monitoring/adjusting device therefor.

BACKGROUND OF THE INVENTION

In the knitting technology, electronic data processing is increasingly employed not only for machine control purposes but also for monitoring/adjusting the production. Furthermore, it is conventional to establish a masterpiece by calculating or producing on the basis of target yarn amounts and to use the masterpiece as a reference for the production of a machine or of an entire machine series. In this case comparisons are carried out with the masterpiece, e.g. with the help of the consumed yarn amounts and/or the developments of the yarn consumption. The yarn consumption is an important aspect for a knitting mill and the specialised personnel. In case of simple, plain knitted and straight tube fabrics and equipment of the circular knitting machine with positive feeding devices, the yarn tensions vary. However, the yarn amounts remain constant in relation to the machine speed such that it does not cause any problems with respect to monitoring and evaluating the yarn consumption. Furthermore, methods exist according to which the yarn amount is measured by means of a measuring roll running in the yarn path, and according to which the measured values are evaluated centrally, however, such methods require excessively high technical efforts and complicate the re-setting, adjustment and changing of the machine setting considerably.

In a device known from EP 0 452 800 A the respective yarn amount is determined and evaluated centrally with the help of measurements of the yarn speed by means of special sensors in the yarn path. The yarn amounts consumed in the masterpiece are used for comparisons with the knitted goods in order to detect and display erroneous uses, incorrect yarn speeds and incorrect machine operation cycles.

In the case of jacquard goods or so-called body stockings, however, non-positive feeding devices of different types operating with different yarn conveying principles are used for different yarn qualities, sometimes even of different producers, at one and the same knitting machine. In such cases, the monitoring and detection of the individual yarn amounts until now is impossible with reasonable control equipment and apparatus efforts. Basically, however, consecutive, sequential or final information of the yarn amounts of such specially equipped knitting machines would be important for the knitting mill owner and the specialised personnel in order to judge and optimise the efficiency of the production, to realise fluctuations of production parameters during the production early on, to save time and labour effort for the pre-setting, changes of the setting and adjustment, and to achieve an optimisation of the quality and continuous high quality with fewer defective goods.

According to a method known from DE 82 24 194 U the yarn amount is measured per revolution of the knitting machine. For this purpose a scanner is co-acting with a band commonly driving all feeding devices provided at the knitting machine. The method can only be used for positive feeding devices at the knitting machine, which positive feeding devices commonly are driven by a band. All feeding devices operate with equal feeding rates and with identical yarn conveying principles.

According to a method as known from EP 0 489 307 A, the entrance speed of each yarn into a knitting system is constantly maintained equal or proportional to an entrance speed which is predetermined by a self-learning cycle on the basis of a masterpiece. Control of the entrance speeds is carried out during the production run of the knitting machine. Furthermore, during the production run a driven actuator, e.g. a roller, pulls the yarn from a storage bobbin such that the yarn is fed during the production run with a constant yarn quantity. The actuator determines the entrance speed of the yarn. The self-learning cycle is carried out prior to the start of the production run of the knitting machine without using the actuators in order to find out respective decisive yarn quantities. The actuators correspond to positive feeding devices. The actuators are identical among each other and operate with equal yarn conveying principles. A sensing roller is provided as a sensor at each yarn between the actuator and the yarn guide into the knitting system of the knitting machine. The sensing roller measures the yarn quantity and informs a console unit or a microprocessor also provided for the drive control of the respective actuator. The roller sensing the yarn quantity is an undesirable additional mechanical load for the yarn and emits imprecise measuring results due to unavoidable slip.

Further prior art is contained in EP 0 752 631 A, EP 0 959 742 A, EP 0 600 268 A, DE 82 24 194 U, EP 0 420 836 A, EP 0 385 988 A, EP 0 489 307 A.

The setting procedure of a knitting machine prior to production or after a change of the settings is particularly time consuming and requires special knowledge, particularly when the knitting machine is equipped with non-positive feeding devices which may even originate from different producers, and even differentiate from each other in terms of the respective yarn conveying principles, because each feeding device including its peripheral, yarn influencing accessory assemblies has to be associated with the respective knitting system and has to be adjusted to an individual and optimum operation. In this case simply achievable information on the individual yarn amounts was of invaluable advantage since a yarn amount deviating from a target indicates for such a feeding device not only a fault condition or a trend, but even allows a direct conclusion to the kind of a fault which then could be corrected rapidly and at that point. Furthermore, in view of this aspect there is considerable demand for a method for an efficient monitoring adjustment of the production for knitting machines having non-positive feeding devices, and for a device allowing for a simpler pre-setting, changing of settings and the adjustment of a knitting machine or even of a knitting machine series.

It is an object of the invention to provide a method of the kind as disclosed above as well a device for carrying out the method which allow a simple and comfortable monitoring/adjustment of the production despite the fact of the existence of non-positive yarn feeding principles of feeding devices of different types which even operate according to different conveying principles.

By carrying out the method such that each individual yarn amount is continuously measured with the help of detected actual rotational signals of the feeding device, a sufficiently precise yarn amount information is achieved from the actual rotational signals under consideration of the storage body circumferential length and without the need to use separate sensors for these tasks. Actual rotational signals are used in any event which result from the operation of the feeding device. Even though several non-positive feeding devices are used at the knitting machine which feed yarn of different qualities and/or elasticity according to at least two different yarn conveying principles, and which even may originate from different producers, the actual rotational signals can be detected easily. According to the method, the individual yarn amounts are detected precisely and deliver information for the monitoring/adjustment of the production. One reason for different feeding device types is that the feeding devices have to cope with different yarn tensions and/or yarn speeds, with one type having better capabilities than another type. Within the frame of the method the individual yarn amounts are not measured primarily to gain the total yarn amount but to indicate with the help of the yarn amounts certain fault conditions in order to allow one to survey and optimise the production in a simple way. As a secondary product, the total yarn amounts can also then be detected with little additional effort. The method is expedient for circular knitting machines, however, it also can be implemented for flat knitting machines. The method concentrates on the recognition that especially in the case of non-positive feeding devices the actual fed yarn amounts allow one to draw conclusions as to a proper operation in the knitting system, at the feeding device and in the yarn path and in view of trends towards a fault condition or even conclusions of certain fault conditions.

From the continuous or final comparison of the individual yarn amounts with corresponding and predetermined target yarn amounts, e.g. of a masterpiece, and within at least one range of tolerance, the operation of each feeding device and at the associated knitting system can be monitored precisely. Critical production conditions and even the reasons therefor can be determined, and measures can be initiated even during the production or after the production in order to correct fault conditions. The method may be upgraded in that a fault condition detected with the help of the comparison of the yarn amounts, which fault condition in most cases is associated with a certain kind of a fault, is corrected automatically, e.g. within a closed adjustment regulation loop using the result of the comparison as the regulation guiding value. Such adjustments can be carried out at the knitting system or at the feeding device or at the peripheral accessory assemblies of the feeding device, because mainly those operation elements mentioned as a selection have an influence on the yarn amount, such that a fault condition occurring at one of these operation elements can be shown ideally with the help of a tolerance variation of the yarn amount in comparison to the yarn amount of the masterpiece. In this case it is important to adapt the width of the range of tolerance used for the comparison even to parameters of the yarn quality and/or the yarn path.

By means of the computerised monitoring/adjustment device, a user friendly tool is offered to the specialised personnel at the knitting machine (circular knitting machine or flat knitting machine) which is important in view of efficient production and short pre-setting procedures, and which may be used to comfortably adjust the pattern of the associations of the feeding devices out of the stock directly at the user surface. So to speak, each feeding device is fictively taken from the stock in view of the yarn quality/elasticity and the position relative to a knitting system and then is operatively associated already in the user surface to the respective knitting system intended for processing this yarn. This allows one to considerably simplify the pre-setting or a change of the setting of the knitting machine, to save time, and to reduce the labour effort. With the assumption that e.g. the circular knitting machine is equipped with a sufficiently huge stock of non-positive feeding devices among which there are at least two operating according to different yarn conveying principles, the device creates a link between the feeding devices and the circular knitting machines as needed for an efficient production, and such that troublesome setting operations at the feeding devices and/or in the machine control are reduced to a minimum. It is obvious that association patterns specific for a respective knitted article may be stored and used or retrieved again upon demand or that an association pattern created for knitted goods in the user surface can be transferred to each further knitting machine producing the same knitted article. For example, a keyboard or the like and/or the display designed as a touch screen may be used as the input/indication-section of the unit.

Expediently, the yarn amounts are measured by detected actual rotational signals, e.g. calculated, and are compared with corresponding target yarn amounts. Since among different yarn feeding device types each comparison is carried out only in view of yarn amounts of one feeding device type, it is possible that the yarn amounts of differing feeding devices are measured in different ways such that a measured value of a yarn amount of one type of a feeding device first does not correspond to the same measured value of the yarn amount of another type. First when the total yarn amount or a yarn amount specific for the knitted goods is to be determined, a conversion or conversion calculation is made into equal length units or weight units. According to the method it is possible to carry out each comparison with the masterpiece with the help of the detected actual rotational signals, e.g. with the help of the type of the signal and/or the number of signals and/or the frequency of the signals in order to detect an individual fault condition or a fault trend, before real yarn amounts or yarn weights are determined.

The method primarily is adapted to the production of knitted goods in circular knitting machines having different feeding device types which operate simultaneously or subsequently and with non-positive yarn feeding principles according to at least two different yarn conveying principles. For example, less elastic yarn is fed by a feeding device including a rotatable storage body, while more elastic yarn is fed by a feeding device including a stationary storage body and a winding element which rotates. Such differing types are selectively used depending on the expected yarn tension and/or the yarn speed. Such equipment of a circular knitting machine is expedient e.g. for so-called body stockings or jacquard knitted goods. However, this equipment may also be of advantage for other high quality knitted goods in which differing yarn qualities and/or different elastic yarns are knitted. The same prerequisites could even be used for flat knitting machines.

In case of a feeding device having a rotating storage body, one actual rotation signal may be scanned per revolution of the storage body. This signal then represents a yarn amount corresponding with the circumferential length of the storage body. In order to achieve a higher resolution it also is possible to scan a predetermined number of actual rotational signals per revolution of the storage body, each of which represents the same part of the circumference of the storage body. In order to simplify the control, the scanning e.g. is carried out by scanning the rotation of the drive motor.

In case of a feeding device having a stationary storage body, expediently, a plurality of actual rotational signals are scanned which represent equal parts of one yarn winding.

Since in the case of a very elastic yarn the windings resting on the stationary storage body may be stretched out, the measurement is more precise if the withdrawn yarn itself is allowed to generate the actual rotational signal.

In view of the method it is expedient to adjust the width of the range of tolerance used for the individual comparison in case of a more elastic yarn, e.g. larger than in the case of a less elastic yarn, since in case of a more elastic yarn parameters occurring along the yarn path gain bigger influence.

According to the method an individual yarn amount comparison cannot only be carried out within a single range of tolerance, but subsequently or parallel even within several ranges of tolerance having increasing widths. In this way and by using a narrow range of tolerances, first a trend can be displayed from the comparison with the development of the yarn amount in the masterpiece in order to derive an alarm signal upon demand, which alarm signals call the specialised personnel to particularly monitor the yarn path, the feeding device or the knitting system, respectively. The next and broader range of tolerance can then be used to derive an adjustment measure in case that the range of tolerance is exceeded. Then the specialised personnel manually carries out adjustments along the yarn path, at the feeding device or at the knitting system, respectively, or such adjustments are even initiated automatically. The largest range of tolerance, finally, may be used to switch off the knitting machine, because an out of tolerance condition then indicates a fault condition which can no longer be corrected.

Especially in the case of a more elastic yarn, conditions in the yarn path may be monitored continuously, e.g. with the help of the tension of the yarn, and may be used e.g. for the adaptation of the width of the range of tolerance used for the comparison and/or to process the scanned actual rotational signals. In case of feeding devices having a rotating storage body, the yarn tension could be measured at the withdrawal side, which yarn tension is important for controlling the drive motor, and then could be used for tuning the actual rotational signals in view of very precise measurements of the yarn amount.

On a further user surface of the display of the production monitoring/adjusting device, the operations of the feeding devices associated with the respective knitting systems may be displayed during the production of a knitted article by the individual yarn amounts in comparison with yarn amounts of the masterpiece, preferably within ranges of tolerance depending e.g. on the yarn quality and/or the respective yarn conveying principle. This expediently may be realised with the help of pictogram strips or bars representing the yarn amounts. The strips or bars are associated with addressed or identified feeding devices and the associated knitting system. An out of tolerance condition optically may be highlighted and e.g. highlighted by a light signal or in acoustic fashion.

Existing knitting machines of such types may be simply retrofitted with the monitoring/adjustment device for the production. In such a case, expediently, the device is positioned within a housing beside the knitting machine or in a cut-out of the foot part of the knitting machine.

Alternatively, the monitoring/adjustment device may be integrated with the display and the inputting/indicating section into the main control system of the knitting machine. This is of advantage in order to allow one to use the same actuation elements for the monitoring/adjustment and even the display of the machine control as otherwise used for the machine control.

Knitting machine feeding devices having rotatable storage bodies are used for less elastic yarns, while feeding devices having stationary feeding bodies, a rotatable winding element, and a counting sensor assembly for yarn windings at the withdrawal side are used for more elastic yarns. In order to allow one to produce different knitted goods, it is recommended that a stock of feeding devices be provided at the knitting machine which is larger than the number of feeding devices operating in production.

The device, expediently, allows one to configure a user surface in which for one or more produced knitted goods, the total yarn amount/the single yarn amount or total yarn weight/single yarn weight can be shown in length units and/or weight units.

Since there is a plurality of data which has to be transmitted rapidly for monitoring/adjusting the production, since many connection locations are needed for fetching data and processing data, and since the cabling should be as simple as possible and should assure high safety of the operation, it is expedient to interlink the knitting machine and its control, the production monitoring/adjustment device, and the feeding devices including the peripheral accessory assemblies in a data bus system, preferably in a rapid CAN-bus system. The feeding devices may be connected in fixed or selective fashion to the bus via interface adapters. Those adapters, at least for some of the used feeding devices, are designed such that the derived needed actual rotational signals for the measurement of the yarn amount are taken by them directly at the feeding device or as pulses which are available in any event from the operation of the feeding device.

BRIEF DESCRIPTION OF THE DRAWINGS

The invention will be explained with reference to the drawings, in which.

DETAILED DESCRIPTION

Figure 1:
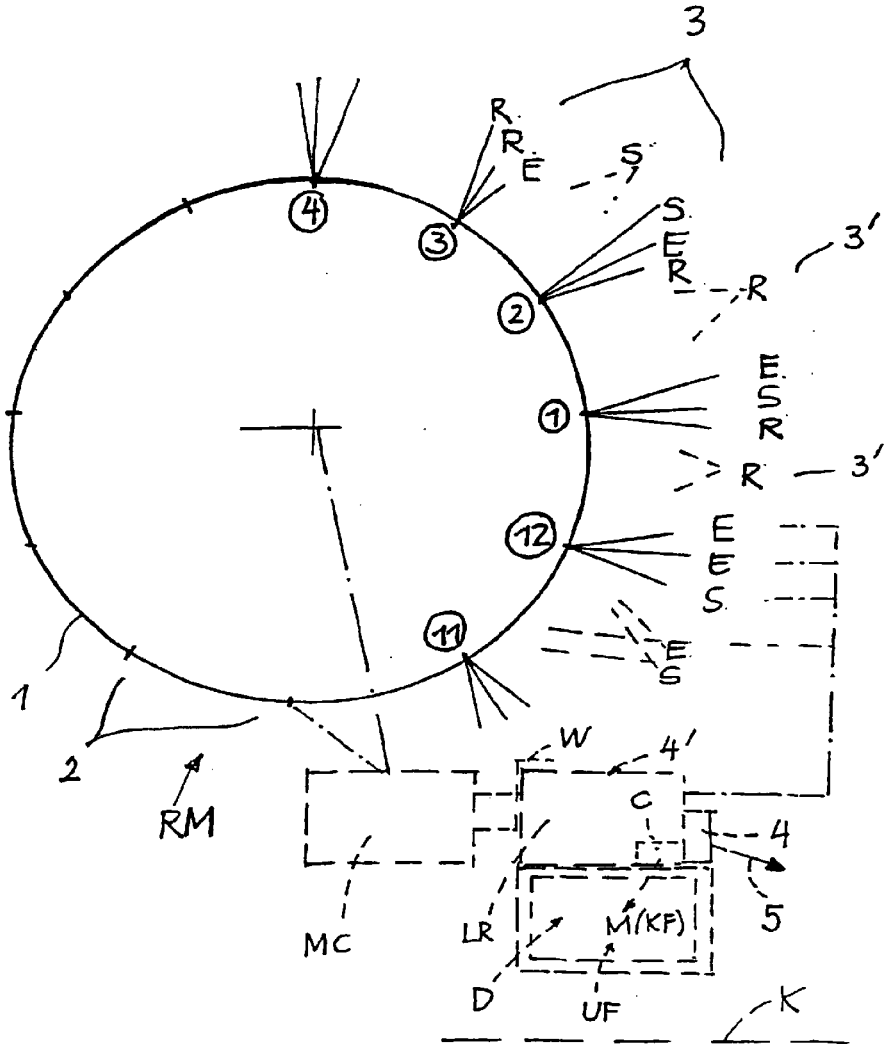
FIG. 1 is a schematic configuration of a circular knitting machine having several knitting systems.

A circular knitting machine RM in FIG. 1 has a cylinder 1 and a machine control MC and is equipped with a production monitoring/adjusting device LR. Distributed along the circumference of the cylinder 1 are several knitting systems 2, e.g. the knitting systems (1) to (12). At least one feeding device R, E, S, and in this case three different types of feeding devices, is operatively associated with selected ones of the knitting systems (1) to (12) (indicated by full lines). The equipment of the respective knitting system with the feeding devices may vary, however, depending on the knitted goods and/or the processed yarn quality and/or the yarn colour and/or the yarn elasticity. The operatively associated feeding devices are indicated in groups 3. Additionally, additional ones of such feeding devices (indicated at 3') may be provided ready for use for a selective operative association (indicated by dotted lines). The knitting machine RM, e.g. is pre-set for the production of body stockings. Alternatively, it may be a circular knitting machine of a jacquard type. The feeding devices are non-positive feeding devices which feed the respective yarns according to at least two different yarn conveying principles.

All feeding devices are, e.g. within a bus system, connected to the production monitoring/adjusting device LR. The device LR comprises a computerised unit 4' having an inputting/indicating section 4, a calculator section C and at least one display D. In the display D different user surfaces may be configured, e.g. an indicated user surface UF for showing the total yarn amount M of one knitted article KF or of a series of knitted goods, respectively.

The monitoring/adjusting device LR may be provided in a separate housing W beside the circular knitting machine RM and may be connected to the knitting machine control MC. Instead, e.g., the device LR may be contained in a not shown detail cut-out in the foot part K of the knitting machine. Alt ernatively, the monitoring/adjusting device LR may be integrated into the knitting machine control MC in order to also use the inputting/indicating section and/or the display D of the knitting machine control MC. The arrow 5 indicated by a dotted line shows that information, association patterns, setting commands or e.g. the total yarn amount M may be transferred to a not shown controlling/monitoring centre, or may be transferred via an on-line connection to knitting machines producing the same knitted goods KF, or may be transferred by means of a handheld controller or an electronic data carrier to further knitting machines of the same kind.

The term non-positive yarn feeding means that there is no fixed correlation between the operation speed of the cylinder and the speed by which the respective feeding device is feeding the yarn, but that the respective yarn tension is maintained essentially constant but the individual yarn amount is varying, in a comparison to a positive feeding principle. In the case of positive feeding the yarn tension varies, however, the fed yarn amount remains constant. The at least two different yarn conveying principles which are used in the available feeding devices mean that along the yarn path differing braking conditions and deflection conditions are present, and that according to one yarn conveying principle yarn windings are intermediately stored for withdrawal on a rotatable storage body while according to the other yarn conveying principle yarn windings are intermediately stored on a stationary storage body such that the yarn is spooled off depending on consumption. This will be explained in more detail with the help of FIG. 2.

Figure 2:
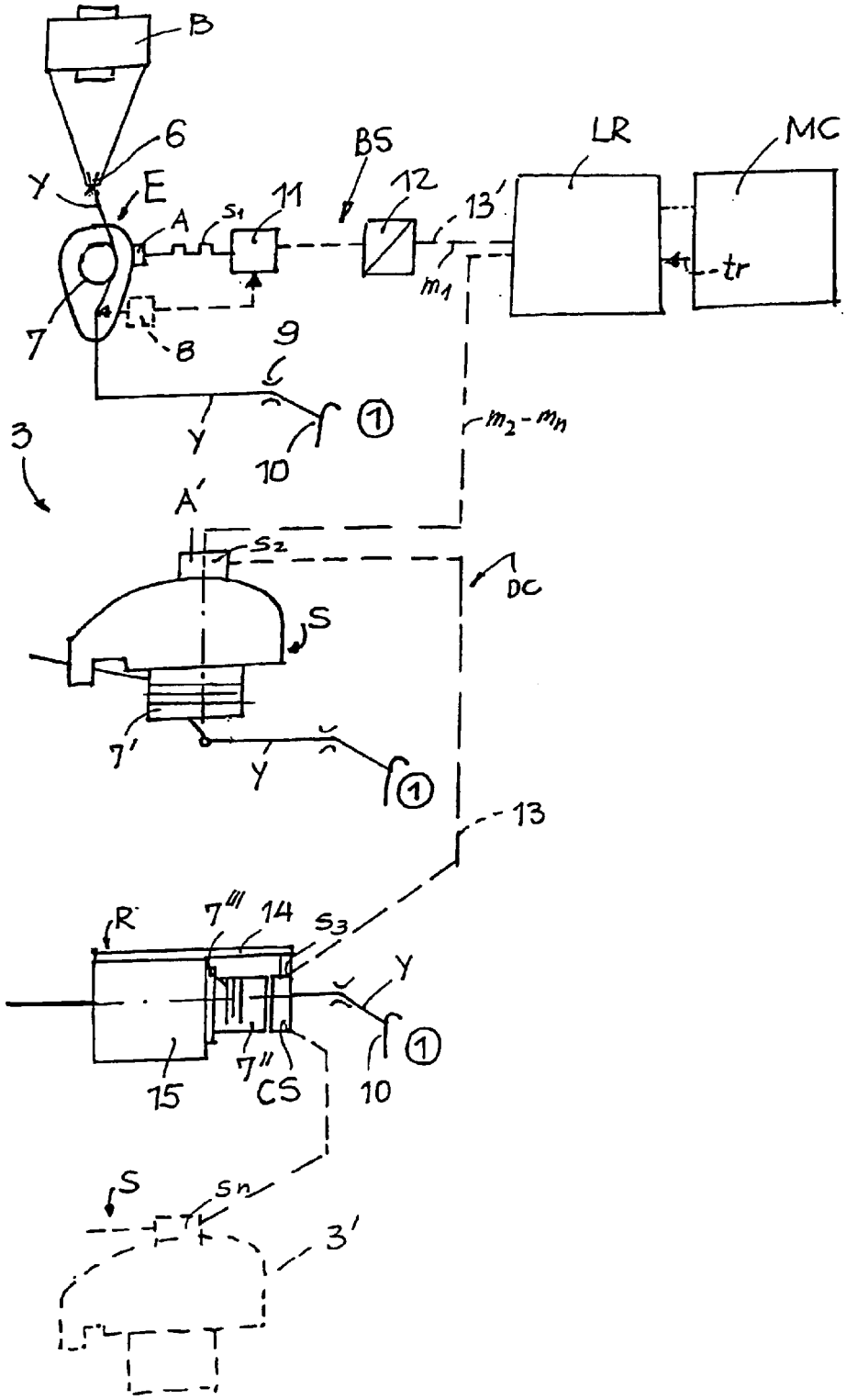
FIG. 2 is a diagram of feeding device equipment of a knitting system and the interlinking between the feeding devices and a production monitoring/adjusting device.

In FIG. 2, four feeding devices E, S, R, and optionally S, are operatively associated with the knitting system (1). Those feeding devices may as well be selectively operatively associated with the different knitting systems (1) to (12) at the cylinder 1 in FIG. 1. The feeding device E by means of its rotating storage body 7 withdraws the yarn Y, e.g. through a braking device 6, from a supply B, stores yarn windings on the storage body, and is feeding the yarn tangentially via a tension scanning device 8 and a yarn guiding element 9 to the knitting system (1) of which a needle 10 is shown. An adapter A scans actual rotational signals s1, e.g. of the drive motor of the storage body 7. These actual rotational signals s1 may be processed in dependence from the measured yarn tension in an electronic assembly 11 which is controlled by the device 8, and are then transmitted via an electronic assembly 12 and a signal line 13', e.g. within a bus system, to the production monitoring/adjusting device LR. The device LR then calculates the individual yarn amount m1 of the feeding device E on the basis of the actual rotational signals s1 as transmitted. The individual yarn amounts m1 may, if desirable, be converted into certain measurement units.

The production monitoring/adjusting device LR is interlinked with the knitting machine control MC and receives e.g. so-called trig signals tr from the knitting machine control MC.

The next shown feeding device S of the group 3 is equipped with a rotatably driven storage body 7' and is as well feeding the knitting system (1) with another yarn Y. The yarn Y tangentially approaches the storage body 7' and is withdrawn overhead of the storage body 7' through a central eyelet. By means of an adapter sensor A', e.g. monitoring the rotation of the drive motor of the storage body 7', actual rotational signals s2 are scanned from the motor shaft which for that purpose may be prolonged and then are transmitted to the monitoring/adjusting device LR within a daisy-chain DC. The respective yarn windings are allowed to slip on the storage bodies 7, 7'.

The feeding device R is of a type having a stationary storage body 7" on which adjacently contacting or separated yarn windings intermediately can be stored as formed by a winding element 7 which is driven for rotation. The yarn windings consecutively are withdrawn overhead of the storage body 7" and are fed as shown to the needle 10 of the knitting system (1). The drive motor of the winding element 7 is contained in a housing 15 carrying a counting sensor assembly CS at a housing outrigger 14. The counting sensor assembly CS derives actual rotational signals s3 directly from the yarn which rotates during withdrawal. The actual rotational signals s3 are transmitted over the daisy-chain DC via the adapter sensor A' of the feeding device S to the monitoring/adjusting device LR for the production.

If necessary, the daisy-chain DC may be extended by a connection 13 to a feeding device S which only is indicated in dotted lines and which may belong to the reserve or stock 3' and which is ready for operation. By the scanned actual rotational signals s2, s3 or $S_n$, the necessary information relating to the respective individual yarn amounts m2 to $m_n$ of the feeding devices S, R, S are transmitted via the daisy-chain to the monitoring/adjusting device LR. By an evaluation of the received information, the monitoring/adjusting device LR has knowledge about each individual yarn amount after the start of production and/or the momentary development of the yarn amounts and/or the total yarn amount M for the produced knitted goods belonging to the production series, and particularly, e.g. under consideration of the trig signals tr in association with the machine run.

A masterpiece of the knitted article to be produced may be used as a production reference. The masterpiece either actually has been produced e.g. with a certain association pattern of the feeding devices to selected knitting systems, or is calculated fictively, and is characterised by the single individual yarn amounts of the entire masterpiece and/or the individual yarn amounts per machine cycle or per machine partial cycle, respectively, and/or by the individual yarn amounts up to a predetermined point in time within the production of the masterpiece. Expediently, the masterpiece has been made or calculated under operation conditions optimised in view of the quality desired. Each knitted article KF produced is continuously related to the masterpiece or sequentially is compared to the masterpiece with the help of the individual yarn amounts m1 to $m_n$. The phenomena of the explained types of feeding devices, namely that in the case of a non-positive yarn feed and according to different yarn conveying principles, an out of tolerance deviation of the individual yarn amount from the corresponding yarn amount of the masterpiece indicates a fault condition along the yarn path and/or at the knitting system and is used here in order to optimise the production or to monitor the production in view of occurring trends or to derive adjusting measures from the comparisons, respectively, in order to correct occurring trends towards defective goods. Adjustment measures as derived then may be carried out manually or automatically by devices e.g. using the respective result of a comparison as a regulating guide value factor within a closed regulating loop. The type of a feeding device respectively employed depends e.g. on the yarn tension and/or the yarn speed with which the feeding device has to cope.

A yarn amount decreasing out of tolerance may be an indication that the loop width in the knitting system has decreased due to contamination or wear or the like, or that a braking condition, guiding condition or deflection condition along the yarn path upstream and/or downstream of the feeding device has become too forceful by contamination or the like. Depending on the type of the respective feeding device, differing adjusting measures may be needed along the yarn path. This is inversely true also for individual yarn amounts increasing out of tolerance in comparison to the corresponding masterpiece yarn amounts. Furthermore, the total yarn amount or the total yarn weight can be determined for each knitted article on the basis of the individual yarn amounts. Alternatively, the total yarn amount or the total yarn weight, respectively, may be pre-calculated in view of the desired production number and e.g. then may be used for the calculation of the efficiency of the production, for the logistic of the yarn supply or the control of the in-house yarn stock.

As the different types of yarn feeding devices differently measure the individual yarn amounts, it is expedient to convert the individual yarn amounts into equal amount units or weight units.

The adapter A of the type E of a feeding device e.g. counts several pulses per revolution of the motor. Each pulse represents a certain yarn amount. The adapter sensor A1 of the type S of a feeding device e.g. counts each revolution of the motor by one pulse, such that each pulse represents a yarn amount corresponding to the circumferential length of the storage body. The counting sensor assembly CS of the type R of a feeding device e.g. counts several pulses per yarn winding withdrawn, such that each pulse represents a certain partial length of a yarn winding. The individual yarn amounts e.g. may be added up continuously for the feeding devices associated with each operating knitting system by using the trig signals emitted by the machine control MC, and then may be compared with the corresponding yarn amounts of the masterpiece in order to monitor in this fashion that each knitted article produced already corresponds very closely to the masterpiece during the production. This will be explained with the help of FIG. 4.

Figure 4:
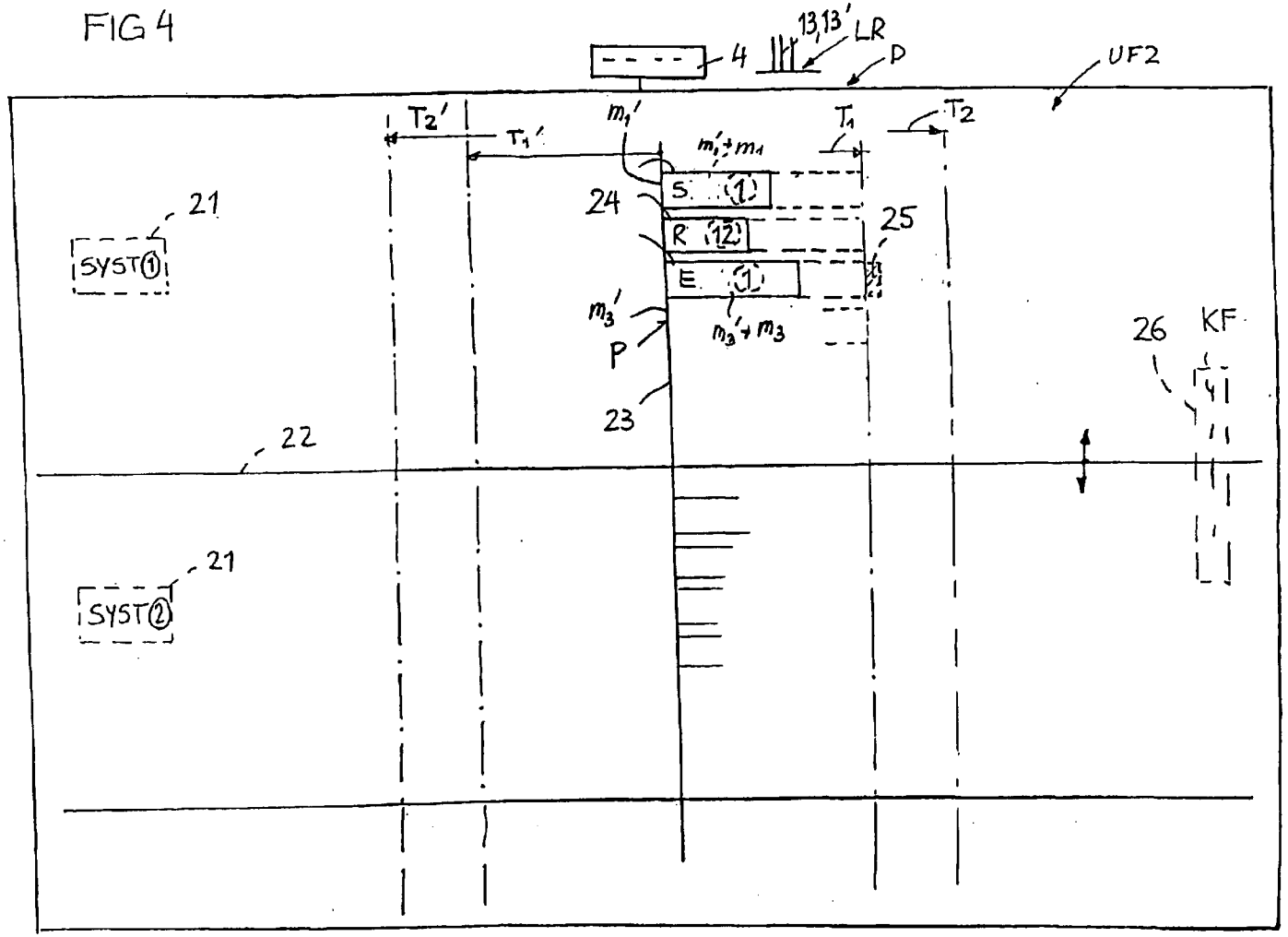
FIG. 4 shows the configuration of a further user surface.

FIG. 4 illustrates schematically a user surface UF2 configured in the display D. In the display D, one field is provided for each knitting system SYST (1) to (12). The user surface UF2 is called up at the inputting/indicating section 4. The respective knitted article KF is identified, optionally with specifications, within a field 26. Separating lines 22 separate the fields from each other. The fields may be shown consecutively, in groups, or alone by scrolling in the user surface. Each operating knitting system is identified within a field 21. The masterpiece P is illustrated by a centre line 23 showing yarn amounts m1', to $m_n$' set to zero and is completed by at least one range of tolerance T1, T2, T1', T2'. Horizontal strips or bars 24 contain the deviations between respective yarn amounts m1 to $m_n$ and m1' to $m_n$'. The yarn amounts m1' to $m_n$' of the masterpiece e.g. may be associated with the momentary point in time within the production cycle of a knitted article. During the production of a knitted article KF, the positive or negative deviations at m1 to $m_n$ are shown in the strip 24 and are monitored within the respective range of tolerance T1, T1' or T2, T2', respectively. Additionally, e.g. by identification S (1), R (12), E (1) the strip 24 is marked to the operatively associated feeding devices. Identical types of feeding devices e.g. are illustrated in strip 24 having the same grey colour tone. In case that an individual amount, e.g. the yarn amount of the feeding device E (1) exceeds the range of tolerance T1 as indicated at 25, then that excess may be highlighted optically and/or acoustically or may be transmitted to a supervising location. As a further alternative, an adjusting measure may even be derived and initiated on the basis of the excess. However, the adjusting measure could even be derived and initiated first when the scanned range of tolerance T2 is exceeded. Then a machine switch off signal may even be generated.

Target yarn amounts m1' to $m_n$' of the masterpiece P are stored in the monitoring/adjusting device for all operating knitting systems. The individual yarn amounts m1 to $m_n$ are calculated on the basis of the information transmitted via the transmitting paths 13, 13' or via a data bus, and then are superimposed with the target yarn amounts.

Figure 3:
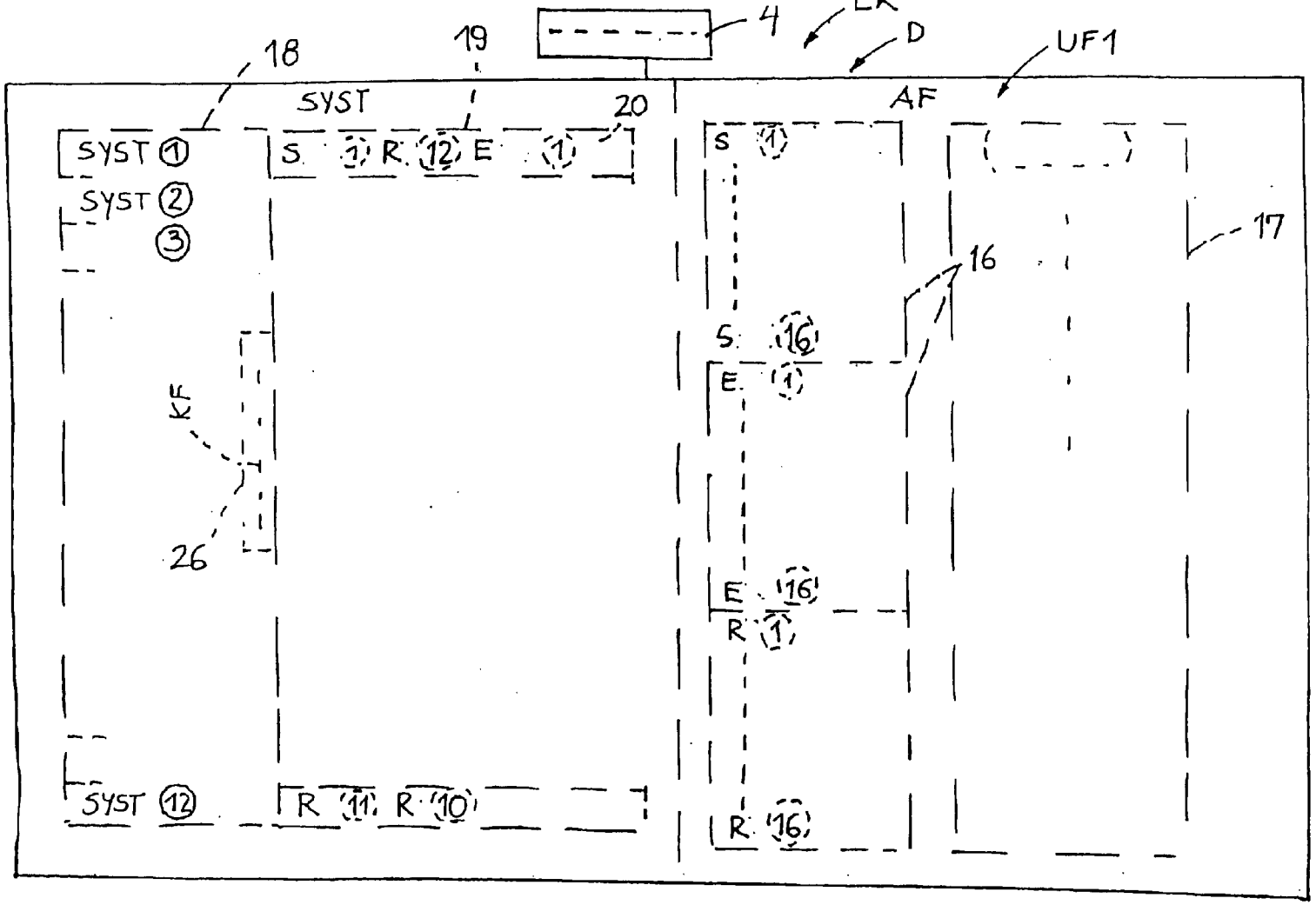
FIG. 3 shows the configuration of a user surface in the display of the monitoring/adjusting device.

Furthermore, the monitoring/adjusting device LR serves to carry out the pre-setting of the circular knitting machine RM. This is explained with the help of FIG. 3. In FIG. 3 another user surface UF1 is configured in the display D. The user surface UF1 contains several fields 16, 17, 18, 19 and sub-fields 20, 26. In the right half of the user surface UF1, the available feeding devices which are installed ready for operation at the knitting machine are shown in the fields 16 below AF in addressed format. As shown there are e.g. three groups, namely all feeding devices S identified by address numbers (1) to (16), further the feeding devices E identified by address numbers (1) to (16), and finally the feeding devices R identified by address number (1) to (16). The field 17 e.g. provides further information and/or is used to fictively place those feeding devices which are not needed for the knitted article identified in field 26. In the left half of the user surface UF1 the knitting systems are illustrated below each other in field 18 by SYST (1) to (12). In the field 19 associated with field 18, sub-fields 20 are provided which belong to the respective knitting systems. By using the inputting/indicating section 4, or in case of a touch screen by directly manipulating the display D, the feeding devices of the desired types are associated with each knitting system one after the other and e.g. in dependence from the yarn which is intended to be knitted there. Such a condition is indicated for the knitting system (1) to which the feeding devices S (1), R (12) and E (1) are associated. The feeding devices associated with the respective knitting system are then either shadowed or extinguished within field 16. In this way the selected knitting systems are pre-set consecutively. Feeding devices of different types which are not associated with any knitting system either remain in the field 16 or automatically are transferred into the field 17. By means of the thus formed association pattern, already associated feeding devices are activated for operation within the bus system.

The final association pattern which is partially indicated in FIG. 3 is stored and associated with the knitting article KF. In case that the masterpiece already has been produced or calculated with the same association pattern, the masterpiece association pattern belonging to the knitted article KF even may be called up directly in one turn for presetting the knitting machine. Furthermore, the association pattern either may be transferred by means of a handheld controller or an electronic data carrier or via an on-line connection to each further circular knitting machine also equipped with a monitoring/adjusting device LR for the production in order to simplify the pre-setting also of the other circular knitting machine.

The system is variable. With the help of the individual yarn amounts and the masterpiece, in each case a respective feeding device E may be used as a master feeder with its yarn amount. Feeding devices of the same type then have to follow the master feeder by their individual yarn amounts. In this case the comparison is carried out between the yarn amount of the master feeder and the individual yarn amounts of all yarn feeding devices of the same type. By equipping the circular knitting machine as mentioned above with the non-positive feeding devices which also differ from each other in view of the yarn conveying principles, even plain knitted fabric can be knitted. In case of knitting plain fabric, the master feeder monitoring principle as mentioned is expedient in order to assure that the same yarn amount is fed at each operating knitting system. In this case the master feeder yarn amount profile in the masterpiece is used as a permanent reference for the comparisons carried out while the production is monitored and when carrying out adjustments.

The total yarn amount M as mentioned in connection with FIG. 1 may be the total yarn amounts of one knitted article or of the total production of knitted goods. It is possible to separately evaluate the single total yarn amounts for each type of a feeding device, and to indicate or to store or even to compare the evaluation results in order to optimise the efficiency of the production.

Furthermore, it is possible, to additionally equip the circular knitting machine with positive feeding devices, to measure the yarn amounts of the positive feeding devices and to consider the measured yarn amounts in the total yarn amount. Measuring the yarn amount of positive feeding devices does not create significant problems as the yarn amount remains constant in proportion to a machine cycle or the machine speed, respectively, and for that reason can be made easily.

Each operating knitting system (1) to (12) of the knitting machine is able to knit a single yarn or to knit alternatingly or simultaneously several yarns. The masterpiece may be knitted with relatively tough yarns instead in order to achieve precise information on the yarn amounts. The yarns knitted in the produced knitted goods, however, may be more elastic or more stretchable or more complicated for knitting than the yarns used for the masterpiece. A yarn stretch occurring then during the knitting process e.g. may be considered among others by the width of the range of tolerance respectively applied. A broader range of tolerance may be used for the comparison in case of a more elastic yarn than for a less elastic yarn. Measuring points for the braking conditions upstream and/or downstream of the feeding device may be provided for all non-positive feeding devices, independent from the respective yarn conveying principle. The measuring points may be connected to the monitoring/adjusting device in order to allow one to judge the yarn path conditions or variations of the yarn path conditions, respectively.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A method for monitoring/adjusting the production of knitted goods in a knitting machine provided with a plurality of feeding devices and a plurality of knitting systems each of which knits at least one yarn into a knitted article and is associated with at least one of the feeding devices, said method comprising the steps of:

feeding yarn to active knitting systems with the feeding devices, which feeding devices operate with non-positive feed and according to at least two different yarn conveying principles;

scanning actual rotational signals directly at the respective feeding devices; and determining the individual yarn amounts fed from the respective feeding devices in each produced knitted article by continuously measuring the individual yarn amounts based upon the scanned rotational signals.

2. The method of claim 1, further comprising:

comparing the individual yarn amounts with corresponding target yarn amounts of a masterpiece and deriving at least one of: information and adjustment measures from such comparisons; and assuming equal feeding device association patterns to knitting systems for the masterpiece and the knitted article in deriving said one information and adjustment measures, comparing the individual yarn amounts with the corresponding target amounts within at least one range of tolerance, wherein a width of the range of tolerance is conformed to parameters associated with at least one of: the yarn quality and the yarn path.

3. The method of claim 1, further comprising:

selecting ones of the feeding devices based upon predetermined parameters for the operation of the active knitting systems and operatively associating the selected feeding devices to the appropriate knitting systems to define respective association patterns, and retrievably storing the association patterns.

4. The method of claim 1, further comprising converting the individual measured yarn amounts into one of:

equal amount units to determine a total yarn amount; and equal weight units to determine a total yarn weight.

5. The method of claim 1, further comprising:

feeding a yarn of a first elasticity to a first one of the active knitting systems associated with a first one of the feeding devices having a rotatably driven storage body, feeding a yarn of a second elasticity greater than the first elasticity to one of: the first active knitting system; and a second one of the active knitting systems associated with a second one of the feeding devices having a stationary storage body and a rotatably driven winding element, and controlling said feeding steps with at least one of: differing yarn tensions and differing yarn speeds.

6. The method of claim 5, wherein with said first feeding device said step of scanning comprises scanning an actual rotational signal of a drive motor of the storage body, said signal representing a yarn amount corresponding to a circumferential length of the storage body.

7. The method of claim 5, wherein with said first/feeding device said step of scanning comprises scanning a predetermined number of actual rotational signals of a drive motor of the storage body, said signals representing yarn amounts corresponding to equal partial lengths of the circumference of the storage body.

8. The method of claim 5, wherein with said second feeding device said step of scanning comprises scanning a plurality of actual rotational signals which respectively represent equal parts of one yarn winding through pulses generated by rotation of the yarn withdrawn in an orbiting manner from the storage body.

9. The method of claim 2, including comparing the individual yarn amounts with the corresponding target amounts within a plurality of tolerance ranges, adjusting the width of at least one tolerance range based upon the characteristics of its corresponding yarn and adjusting the width of another tolerance range differently based upon one of: the characteristics of its corresponding yarn; the yarn tension; and the yarn speed.

10. The method of claim 2, including comparing each individual yarn amount with the corresponding target amount within a first tolerance range, and if the yarn amount exceeds the first tolerance range generating an alarm signal, comparing each individual yarn amount with the corresponding target range within a second tolerance range having an adjusted width greater than a width of the first tolerance range, and if the yarn amount exceeds the second tolerance range making a corrective adjustment, comparing each individual yarn amount with the corresponding target range within a third tolerance range having an adjusted width greater than the width of the second tolerance range, and if the yarn amount exceeds the third tolerance range, generating a signal to switch off the knitting machine.

11. The method of claim 2, including detecting one of: yarn braking conditions, yarn guiding conditions; and yarn deflecting conditions for the respective feeding device, and adjusting the width of the tolerance range based upon the detected conditions.

12. An arrangement for monitoring/adjusting the production of knitted goods including a knitting machine, said knitting machine including a plurality of knitting systems and a plurality of feeding devices in an operative state and associated with said knitting systems for non-positive feeding of yarn according to at least two different yarn-conveying principles, said arrangement including a computerized unit connected to said feeding devices and including an input and a display on which a plurality of different user interfaces are configurable, a first of said user interfaces indicating yarn amounts fed to active ones of said knitting systems and a second of said user interfaces indicating an association of each feeding device with a specific knitting system, which feeding device is selected according to an optimum yarn-conveying principal of said specific knitting system, said computerized unit being configured to retrievably store an association pattern between the respective feeding devices and the corresponding knitting systems.

13. The arrangement of claim 12, wherein said knitting machine comprises a circular knitting machine.

14. The arrangement of claim 12, wherein said first user interface is configured to continuously display the operation of said feeding devices during the production of a knitted article in individual measured yarn amounts in comparison with stored masterpiece yarn amounts within individual ranges of tolerances which are set based upon one of: the quality of the yarn; and the yarn-conveying principal.

15. The arrangement of claim 12, wherein said arrangement includes a housing separate from and disposed adjacent said knitting machine, and said computerized unit is disposed in said housing.

16. The arrangement of claim 12, wherein said knitting machine includes a foot portion which defines therein a cut-out in which said computerized unit is disposed.

17. The arrangement of claim 12, wherein said knitting machine includes a controller, said computerized unit being integral with said controller and sharing said display and said input therewith.

18. The arrangement of claim 12, wherein a first of said plurality of feeding devices includes a rotatably driven storage body for use with one of: yarns having a first elasticity; a first predetermined range of yarn tension; and a first predetermined range of yarn speed, a second of said feeding devices includes a stationary storage body, a rotatably driven winding element, and a yarn winding counting sensor assembly at a withdrawal side of said stationary storage body for use with one of: yarns having a second elasticity greater than said first elasticity; a second predetermined range of yarn tension; and a second predetermined range of yarn speed, said second predetermined ranges being different from said first predetermined ranges, and said second user interface being configured to display said first and second feeding devices within a stock field adjacent a field identifying said knitting systems.

19. The arrangement of claim 18, wherein said first feeding device includes a pulse-counting adapter connected to said computerized unit, said adapter generating one of: a rotational signal of a drive motor of said storage body representative of a yarn amount corresponding to a circumferential length of said storage body; a predetermined number of rotational signals of a drive motor of said storage body representative of equal partial lengths of the circumference of said storage body, and said yarn winding counting sensor assembly of said second feeding device is configured to generate pulses during withdrawal of each yarn winding from said storage body.

20. The arrangement of claim 12, wherein the yarn amounts indicated on said first user interface are displayed in one of: units of yarn length and yarn weight, and the yarn amounts comprise the yarn amounts as fed by each said feeding device for at least one knitted article.

21. The arrangement of claim 12, wherein said knitting machine includes a controller, said controller being connected to said computerized unit and to said feeding devices by a CAN-bus system, said feeding devices being connected to said bus system by adapters.

22. The arrangement of claim 12, wherein said knitting machine includes a controller, said controller being connected to said computerized unit and to said feeding devices by a daisy-chain.

* * * * *